US005364338A

United States Patent [19]

Terashima

[11] Patent Number: 5,364,338

[45] Date of Patent: Nov. 15, 1994

[54] ROLLING MASSAGER

[76] Inventor: Katsu Terashima, 8-2, Yahiro 3-chome, Sumida-ku, Tokyo, Japan

[21] Appl. No.: 917,298

[22] Filed: Jul. 23, 1992

[30] Foreign Application Priority Data

May 22, 1992 [JP] Japan ..... 4-41039[U]

[51] Int. Cl.[5] ..... A61H 15/00

[52] U.S. Cl. ..... 601/120; 601/118

[58] Field of Search ..... 601/118–121, 601/129, 130, 131, 132, 133, 134, 135, 136, 137

[56] References Cited

U.S. PATENT DOCUMENTS

| | | | |
|---|---|---|---|
| D. 248,493 | 7/1978 | Moncrief | 128/57 |
| 1,265,083 | 5/1918 | Hoard | 128/57 |
| 1,533,528 | 4/1925 | Weaver | 128/57 |
| 2,168,975 | 6/1937 | Clarke | 128/62 |
| 2,577,129 | 12/1951 | Johnston | 128/57 |
| 3,419,268 | 12/1968 | Bellet | 128/57 |
| 5,123,406 | 6/1992 | Masuda | 128/57 |

FOREIGN PATENT DOCUMENTS

| | | | |
|---|---|---|---|
| 1081487 | 7/1953 | France | 128/57 |
| 2639038 | 8/1976 | Germany | 128/57 |
| 350621 | 6/1931 | United Kingdom | 128/57 |

*Primary Examiner*—Robert A. Hafer
*Assistant Examiner*—David J. Kenealy
*Attorney, Agent, or Firm*—Nixon & Vanderhye

[57] ABSTRACT

A portable massager allows self-massaging to be performed in virtually any position. The massager includes at least one pair of pressers mounted at a fixed separation interval onto a rod, which can be separated into two sections, if desired. The pressers may be freely rotatable or non-rotably fixed in position on the rod. The surfaces of the pressers are formed into irregular shapes having indentations and projections. Handles having grips on their ends are either fixed or mounted so as to rotate freely on the rod and project outwardly away from the pressers and toward a respective end of the rod.

12 Claims, 3 Drawing Sheets

ROLLING MASSAGER

BACKGROUND AND SUMMARY OF THE INVENTION

A simple massager, which stimulates effective spots along the spine by itself without requiring a human operator, was commercially available in the past. This massager contained two pressers held down by springs on a base. The method of use of this massager involved first placing the above-mentioned massager beneath the back while lying down. When the weight of the body is applied to the pressers, pressure is applied to the effective spots on both sides of the spine. In the case of applying pressure to other effective spots, the above-mentioned procedure is repeated while sequentially moving the massager to the desired locations. In addition, a single, long rod was also commercially available as a health device for exercise of the arms and body.

However, in the case of the above-mentioned massager of the prior art, it was necessary to select a specific place and time to use the massager while lying down. Consequently, this massager had the problem of not being able to perform massage as desired, such as whenever one happened to desire a massage or whenever one felt pain. In addition, as the above-mentioned long rod was only use for physical exercise, it had no other application.

The present invention relates to a massager able to massage effective spots located on the back, and particularly, both sides of the spine, as well as exercise the arms and body.

The present invention attempts to provide a portable massager that allows massaging at any time when sitting or standing in a location such as an office and which is also useful in exercising the arms and body.

In order to accomplish the above-mentioned object, the means of the massager of the present invention comprises a support rod formed of a lightweight material such as aluminum or plastic, and at least one pair of pressers that are allowed to rotate freely and are coaxially mounted at a fixed separation interval onto the rod, the surfaces of which are molded into irregular shapes having indentations and projections. In addition, handles having grips on their ends may be fixed to the support rod to the outside of the pressers. It is desirable that the pressers be mounted so as to rotate freely relative to the rod and be linked together by linking members so that the separation interval between the two pressers does not change. Alternatively, ring-shaped indentations may be formed at the portions of the rod where the pressers are mounted so that the separation interval between the two pressers does not change as a result of being mounted in such indentations. In addition, a plurality of indentations may be provided to allow the separation interval of the pressers to be adjusted in dependence upon the curvature of the body. The support rod is preferably formed of two substantially equal length rod sections coaxially joined to one another. Therefore, one particularly preferred embodiment of the present invention may be comprised of a support rod comprised of the lightweight material such as aluminum or plastic, and at least one pair of pressers fixed on the rod at a separation interval suitable for the user, the surfaces of which are molded into irregular shapes, and wherein, handles having grips on their ends may be mounted on the rod to the outside of the pressers so that the rod is able to rotate and wherein the rod is separable and reconnectable at roughly its center.

The masssager of the present invention as described above massages by the projections of pressers, which are formed in an irregular shape, thereby massaging effective spots on both sides of the spine in the manner of finger pressure. By moving the rod up and down while positioning the pressers on both sides of the spine by either holding onto the ends of the rod with both hands or supporting the ends of the rod by pinching the rod ends with the bend of the person's elbows, while at the same time grasping each handle with his hands, the pressers roll over the back thereby suitably applying pressure to the above-mentioned effective spots. Thus, there is no need to perform massage while lying down, and massages can be given at any location, both indoors and outdoors. Moreover, in the invention in which handles are used, by moving the rod up and down by holding onto the handles attached to the rod with both hands, excessive force is not applied to the arms caused by holding onto the rod while moving it up and down. In addition, since effective spots can be found both efficiently and accurately, massages can be performed comfortably.

Moreover, if the rod is separable into two rod sections, it be made more compact thereby facilitating portability.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
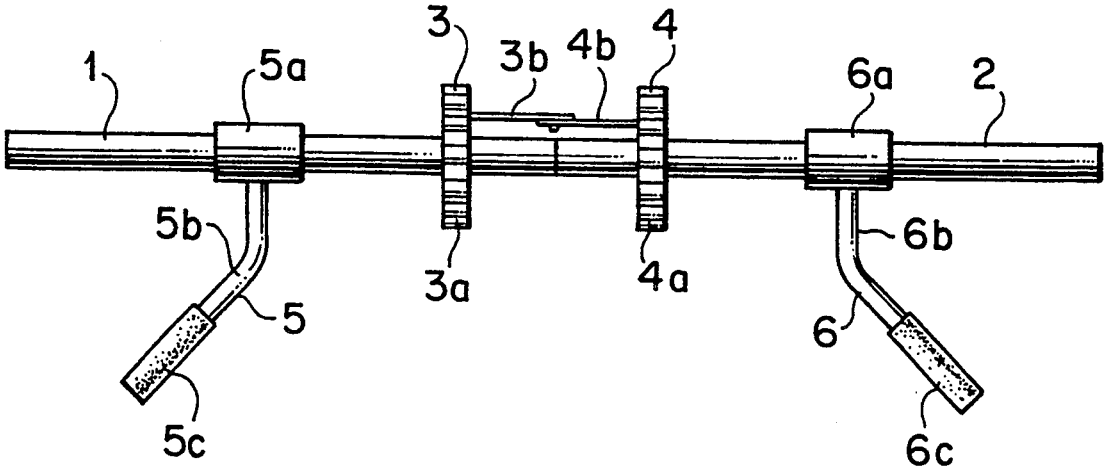
FIG. 1 is a front view indication of a preferred embodiment of the massager of the present invention.
Figure 2:
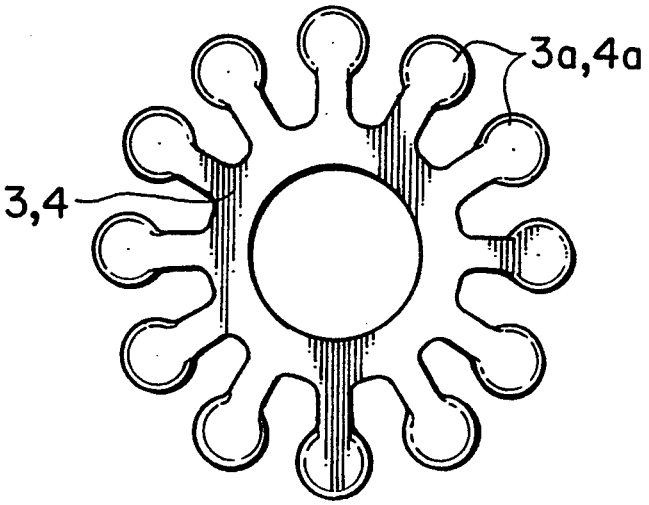
FIG. 2 is an enlarged front view of the presser portion of the above-mentioned massager.
Figure 3:
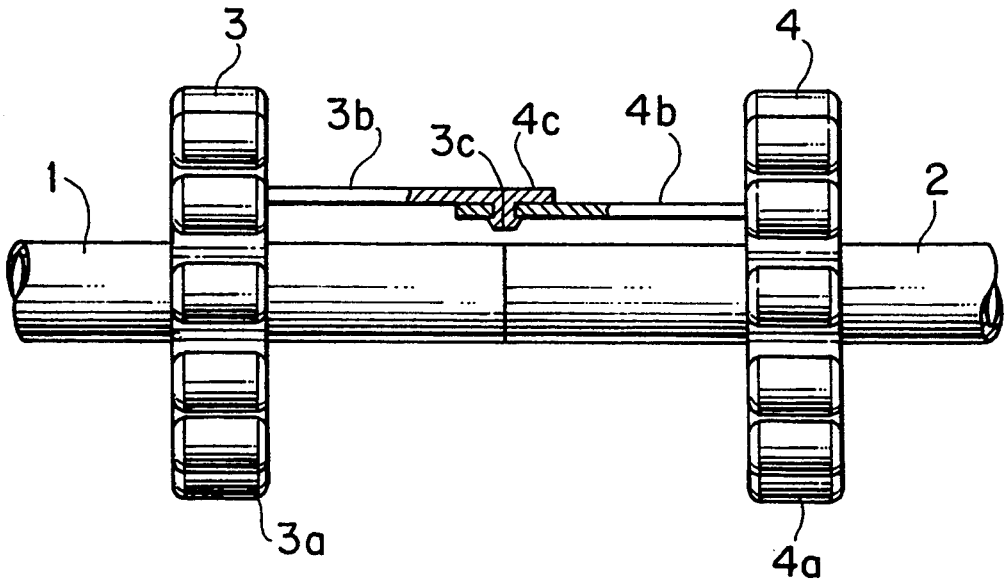
FIG. 3 is an enlarged side view of a presser.

The following provides a description of a preferred embodiment of the massager pertaining to the present invention while referring to FIGS. 1 through 3.

Reference numerals 1 and 2 are rod sections which are formed of a lightweight materials such as aluminum or plastic. The ends of rod sections 1 and 2 are formed into a shape that allows separation and re-connection relative to one another. In other words, a projection is formed on one end of rod section 1, for example, and a L-shaped hole is formed in one end of rod section 2 that engages with the above-mentioned projection. The means for connecting rod sections 1 and 2 may, however, be any mechanical equivalent to that described above.

Pressers 3 and 4 are preferably formed of comparatively hard materials such as plastic or wood. Pressers 3 and 4 are ring-shaped and are able to rotate freely relative to rod sections 1 and 2 on which they are mounted. Moreover, projections 3*a* and 4*a* are formed on the surfaces or pressers 3 and 4, respectively in order to obtain finger pressure effects and prevent slipping. The pressers 3 and 4 may be coupled together in the form of a ring by passing a rubber cord through a plurality of plastic balls.

Linking member 3*b* and 4*b* project from the side of pressers 3 and 4, respectively, so as to connect the adjacent pressers 3, 4 one to another. Projection 3*c* is formed on the end of linking member 3*b* associated with presser 3, while small hole 4*c* is formed in the end of linking member 4*b* associated with presser 4. As a result of projection 3*c* engaging with small hole 4*c*, the two pressers 3 and 4 are mounted on rod sections 1 and 2 and are maintained at a fixed separation interval. In addition, it is desirable that the linking members 3, 4 be constructed so as to allow the distance therebetween to be changed according to the preference of the user. Metal handles 5 and 6 are attached laterally outside of the respective locations where the pressers 3 and 4 are mounted onto the rod sections 1 and 2. Annular sleeves 5*a* and 6*a* are attached to the metal handles 5 and 6 so that both are positionally fixed to rod sections 1 and 2, but are removable therefrom. L-shaped extension arms 5*b* and 6*b* extend transversely from the annular sections 5*a* and 6*a* and are canted outwardly in a direction away from the pressers 3 and 4, respectively. In addition, grips 5*c* and 6*c*, made of a slip-resistant material such as rubber, are fixed on the ends of arms 5*b* and 6*b*.

Figure 4:
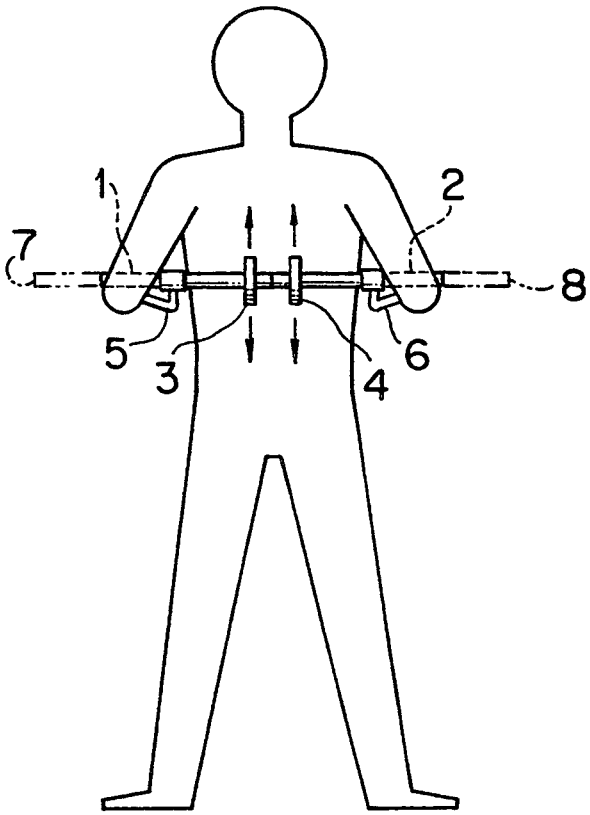
FIG. 4 is a schematic drawing indicating the massager massaging the back.

As a result of the massager being composed in the manner described above, when rod sections 1 and 2 are moved up and down while applying pressure to both sides of the spine with pressers 3 and 4, positioned at those locations by either pinching both ends of rod sections 1 and 2 in the bend of a person's elbows and/or holding onto grips 5*c* and 6*c* of handles 5 and 6 in the manner of FIG. 4, projections 3*a* and 4*a* apply pressure to effective spots while pressers 3 and 4 rotate on both sides of the spine. In addition, if twisting movement of the body is added to this vertical movement, the massager of the present invention can also be used to exercise the arms and body.

Figure 5:
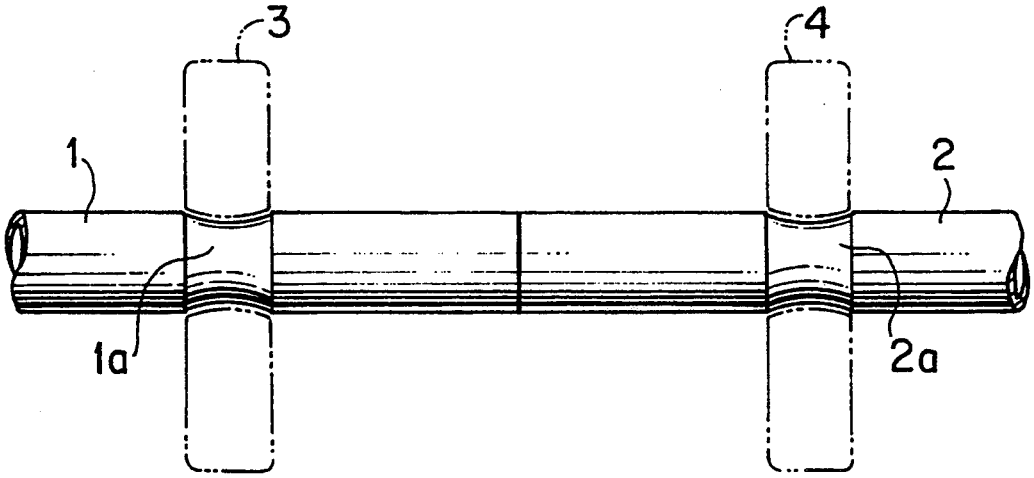
FIG. 5 is a front view of the pressers mounted onto the rod so as to be allowed to rotate freely.

Furthermore, in the above-mentioned preferred embodiment, although the interval between the two pressers 3 and 4 is prevented from changing as a result of linking by linking members 3*b* and 4*b*, the pressers 3 and 4 can be made to rotate at a single location on rod sections 1 and 2 by forming ring-shaped indentations 1*a* and 2*a* on rod sections 1 and 2 and mounting pressers 3 and 4 on such indentations 1*a* and 2*b* as indicated in FIG. 5. Thus, linking members 3*b* and 4*b* become unnecessary in such an embodiment. In addition, the distance between the pressers 3 and 4 can be easily adjusted to match the curvature of the body by providing a plurality of such indentations 1*a* and 2*b* on rod sections 1 and 2, respectively.

Pressers 3 and 4 need not always be allowed to rotate freely on rod sections 1 and 2, but rather may be non-rotably on rod sections 1 and 2. In this case, if rod sections 1 and 2 are allowed to rotate inside the user's arms when the massager of the present invention is moved up and down while the user holds both ends of rod sections 1 and 2, projections 3*a* and 4*a* of pressers 3 and 4 will not slide over the back, but instead will impart finger pressure effects. Moreover, in the case of attaching handles 5 and 6 to rod sections 1 and 2 in the massager in which presser 3 and 4 are fixed on rod sections 1 and 2 in this manner, by attaching annular sleeves 5*a* and 6*a* of handles 5 and 6 to rod sections 1 and 2 so that they are allowed to rotate freely relative to one another, in addition to the pressers 3 and 4 moving easily to obtain finger pressure effects, wear and damage to clothing can also be prevented.

Figure 6:
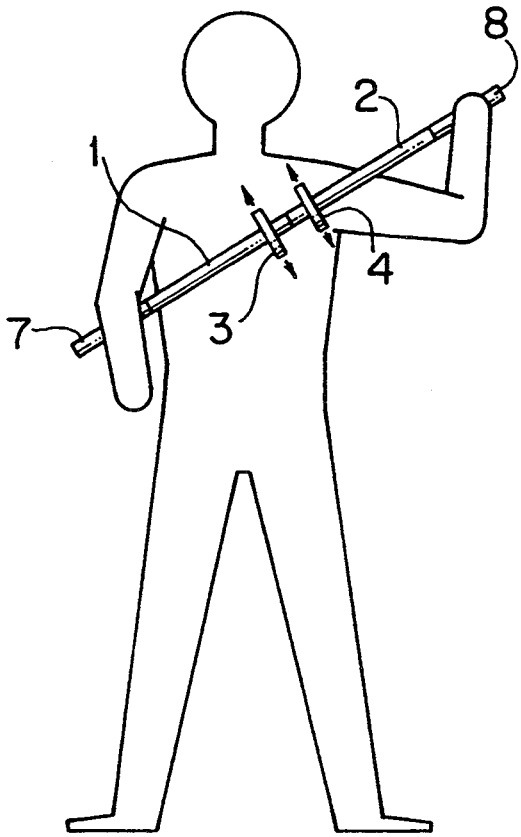
FIG. 6 is a schematic drawing of the massager massaging the shoulder.

FIG. 6 indicates one manner in which the shoulders of a user may be massaged using the massager of the present invention. As rod sections 1 and 2 of the above-mentioned preferred embodiment are not long enough and have a low degree of flexibility, self-massage of the user's shoulders cannot be performed by holding onto both ends of rod sections 1 and 2. Therefore, in the preferred embodiment for such a situation, flexible auxiliary pipes 7 and 8, formed from rubber pipe or rubber rods, are preferably connected to the ends of rod sections 1 and 2. Self-massage may then be performed by supporting pipes 1 and 2 with auxiliary pipes 7 and 8 (See also, FIG. 1.).

What is claimed is:

1. A massager comprising:

an elongate rigid support rod having opposed terminal end portions;

flexible extension rods joined to each said terminal end portion of said rigid support rod;

at least one pair of separated pressers mounted to said support rod for massaging a person's body; and a pair of handles each joined to and transversely extending from said elongate support rod at a location laterally outside of a respective one of said pressers, wherein said handles include rigid extension arm members which are each canted away from said pressers in a direction of a respective adjacent terminal end portion of said support rod, whereby said massager may be held by a person pinching each said terminal end portion of said support rod at a bend of that person's elbows while also manually grasping each said extension arm with that person's hands.

2. A massager as in claim 1, wherein body-engaging surfaces of said at least one pair of pressers include shaped projections and/or indentations.

3. A massager as in claim 1, wherein said extension arm members each include grips.

4. A massager as in claim 1, wherein each said extension arm is generally L-shaped.

5. A massager as in claim 1, wherein said at least one pair of pressers are rotatably joined coaxially to said support rod.

6. A massager as in claim 1, wherein said at least one pair of pressers include a linking member which links said pressers one to another so as to maintain separation of said pressers.

7. A massager as in claim 1, wherein said at least one pair of pressers are non-rotatably joined to said support rod.

8. A massager as in claim 1, wherein said support rod includes at least one pair of annular indentations, and wherein said at least one pair of pressers are rotatably seated in a respective one of said indentations.

9. A massager as in claim 1, wherein said support rod includes a pair of separable rod sections coaxially joined to one another.

10. A massager as in claim 9, wherein said rod sections are each substantially the same length.

11. A massager as in claim 1, wherein said handles each include a sleeve member which is sleeved over said rod laterally outside of said pressers, and wherein said extension arms have one end fixed to said sleeve member and another end which is bent outwardly away from said pressers.

12. A massager as in claim 11, wherein said sleeve member is immovably fixed to said rod.

* * * * *